US007549843B2

(12) United States Patent
Liang

(10) Patent No.: US 7,549,843 B2
(45) Date of Patent: Jun. 23, 2009

(54) TURBINE AIRFOIL COOLING SYSTEM WITH AXIAL FLOWING SERPENTINE COOLING CHAMBERS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 397 days.

(21) Appl. No.: 11/509,228

(22) Filed: Aug. 24, 2006

(65) Prior Publication Data

US 2008/0050241 A1 Feb. 28, 2008

(51) Int. Cl.
*F01D 5/18* (2006.01)

(52) U.S. Cl. ..... 416/97 R; 415/115

(58) Field of Classification Search ..... 415/115; 416/96 R, 97 R

See application file for complete search history.

(56) References Cited

U.S. PATENT DOCUMENTS 3,736,071 A * 5/1973 Kydd ..... 416/97 R
3,849,025 A * 11/1974 Grondahl ..... 416/97 R
4,118,145 A * 10/1978 Stahl ..... 416/96 R
5,536,143 A 7/1996 Jacala et al.
5,820,337 A * 10/1998 Jackson et al. ..... 415/200
5,967,752 A 10/1999 Lee et al.
5,971,708 A 10/1999 Lee
6,099,252 A 8/2000 Manning et al.
6,709,230 B2 * 3/2004 Morrison et al. ..... 415/115
6,832,889 B1 12/2004 Lee et al.
6,902,372 B2 6/2005 Liang
6,957,949 B2 * 10/2005 Hyde et al. ..... 416/97 R
6,981,840 B2 1/2006 Lee et al.
2005/0008487 A1 1/2005 Lee et al.
2005/0111976 A1 5/2005 Lee
2005/0129508 A1 6/2005 Fried et al.
2005/0169752 A1 8/2005 Lee et al.
2005/0226726 A1 10/2005 Lee et al.

* cited by examiner

*Primary Examiner*—Ninh H Nguyen

(57) ABSTRACT

A cooling system for a turbine airfoil of a turbine engine having suction and pressure side serpentine cooling channels formed between an internal support core and an outer wall of the turbine airfoil. The suction and pressure side serpentine cooling channels may be formed from legs extending in a general chordwise direction between leading and trailing edges of the airfoil. The suction and pressure side serpentine cooling channels may receive cooling fluids from a cooling fluid supply source through a cooling fluid inlet, pass the cooling fluids through the cooling system and exhaust the cooling fluids through a cooling fluid exhaust orifice proximate to the tip section. The cooling system is particularly suitable for use with low cooling fluid flow.

18 Claims, 4 Drawing Sheets

TURBINE AIRFOIL COOLING SYSTEM WITH AXIAL FLOWING SERPENTINE COOLING CHAMBERS

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Thus, a need exists for a cooling system capable of providing sufficient cooling to turbine airfoils.

SUMMARY OF THE INVENTION

This invention relates to a cooling system for turbine airfoils used in turbine engines. In particular, the turbine airfoil cooling system may include an internal cavity positioned between outer walls of the turbine airfoil. The cooling system may also include a suction side serpentine cooling channel and a pressure side serpentine cooling channel that each extend along the length of the turbine airfoil with legs that extend in a generally chordwise direction. Such a configuration works well with low cooling fluid flow turbine airfoils.

The turbine airfoil may be formed, in general, from a generally elongated, hollow airfoil having a leading edge, a trailing edge, a tip section at a first end, a root coupled to the airfoil at an end generally opposite the first end for supporting the airfoil and for coupling the airfoil to a disc. The airfoil may include a cooling system formed from at least one cavity in the elongated, hollow airfoil. The outer wall forming the generally elongated airfoil may include a portion proximate to a suction side of the generally elongated airfoil.

The turbine airfoil may include an internal support core positioned in the at least one cavity forming a suction side serpentine cooling channel positioned proximate to a suction side of the generally elongated airfoil and defined by the internal support core and the outer wall and a pressure side serpentine cooling channel positioned proximate to a pressure side of the generally elongated airfoil and defined by the internal support core and the outer wall. The suction and pressure side serpentine cooling channels may be formed from a plurality of legs that are positioned in a generally chordwise direction from the leading edge to the trailing edge of the generally elongated, hollow airfoil.

The cooling system may also include a leading edge impingement channel extending along the leading edge of the generally elongated hollow airfoil. The leading edge impingement channel may be configured such that cooling fluids from the suction side and pressure side serpentine cooling channels may impinge on the backside surface of the outer wall forming the leading edge. The cooling system may also include a trailing edge impingement channel extending along the trail edge of the generally elongated hollow airfoil. The trailing edge impingement channel may be configured such that cooling fluids from the suction side and pressure side serpentine cooling channels may impinge on the backside surface of the outer wall forming the trailing edge.

The cooling system may include a cooling fluid inlet positioned proximate to the root of the airfoil blade that places the suction side and pressure side serpentine cooling channels in fluid communication with a cooling fluid supply source. A cooling fluid exhaust orifice may be positioned in the trailing edge proximate to the tip section of the generally elongated hollow airfoil and in fluid communication with the suction side and pressure side serpentine cooling channels.

The cooling system may include a plurality of trip strips extending into the suction side serpentine cooling channel from an inner surface of the outer wall and a plurality of trip strips extending into the pressure side serpentine cooling channel from an inner surface of the outer wall. The plurality of trips strips in the pressure and suction side serpentine cooling channels may be positioned at acute angles between a chordwise direction and a spanwise direction.

The suction side and pressure side serpentine cooling channels may be formed in variable sizes, widths, lengths and configurations to accommodate localized heating loads. In one embodiment, a leg forming a portion of the suction side serpentine cooling channel may have a width proximate to the leading edge that differs from a width of the same channel proximate to the trailing edge. A leg forming a portion of the pressure side serpentine cooling channel may have a width proximate to the leading edge that differs from a width of the same channel proximate to the trailing edge. A width of the suction side serpentine channel between the internal support core and the outer wall may differ from the root to the tip section of the generally elongated hollow airfoil, and a width of the pressure side serpentine channel between the internal support core and the outer wall may differ from the root to the tip section of the generally elongated hollow airfoil. In addition, a width of the suction side serpentine channel between the internal support core and the outer wall differs from a width of the pressure side serpentine channel between the internal support core and the outer wall.

An advantage of this invention is that the suction and pressure side serpentine cooling channels route cooling fluids from the leading edge to the trailing edge and back again multiple times before being discharged near the tip section of the airfoil. Such a design yields a lower and more uniform blade sectional mass average temperature at lower blade span heights, which improves blade creep life capability.

Another advantage of this invention is that the cooling system achieves the desired blade creep design requirement for the airfoil. The cooling fluid increases in temperature in the suction side and pressure side serpentine cooling channels as it flows outward, thus inducing hotter sectional mass average temperature at upper blade span than at lower blade spans. The pull stress at the blade upper span is low, and the allowable blade metal temperature is high.

Yet another advantage of this invention is that the cooling flow originates from the root at the leading and trailing edges and proceeds towards the tip section, thereby providing cooler leading and trailing edges proximate to the platform, thus enhancing blade HCF capability.

Another advantage of this invention is that centrifugal forces create a centrifugal pumping effect on the cooling fluids in the cooling system and thereby increase the cooling fluid air pressure as it moves radially farther from the root of the airfoil. The increased pressure offsets the pressure loss attributable to turn loss and friction loss in the serpentine cooling channels.

Still another advantage of this invention is that the increased pressure due to the centrifugal pumping effect enables a lower cooling air supply pressure to be used, which yields a lower leakage flow around the blade attachment and reduced temperature cooling fluid.

Another advantage of this invention is that the cooling fluids impinge on the leading and trailing edges, thereby creating a very high internal heat transfer coefficient. In addition, each fluid at the leading and trailing edge turns causes a momentum change, which results in an increase of heat transfer coefficient.

Yet another advantage of this invention is that the suction and pressure side serpentine cooling channels can be tailored to accommodate the heat loads on the exterior surfaces of the airfoil. The channel width for the pressure side serpentine cooling channel may differ from the suction side serpentine cooling channel and thereby change the cooling fluid flow between the pressure and suction side serpentine cooling channels. The channel widths of the legs of the suction and pressure side cooling channels may be varied axially, which impacts the cooling flow mass flux and alters the cooling capability and metal temperature along the flow path.

Another advantage of this invention is that the suction side or the pressure side serpentine cooling channels may have a convergent nozzle geometry immediately upstream from the cooling fluid exit orifice. Such configuration enhances the airfoil leading and trailing edge impingement jet velocity and increases the impingement heat transfer coefficient and airfoil edge cooling.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
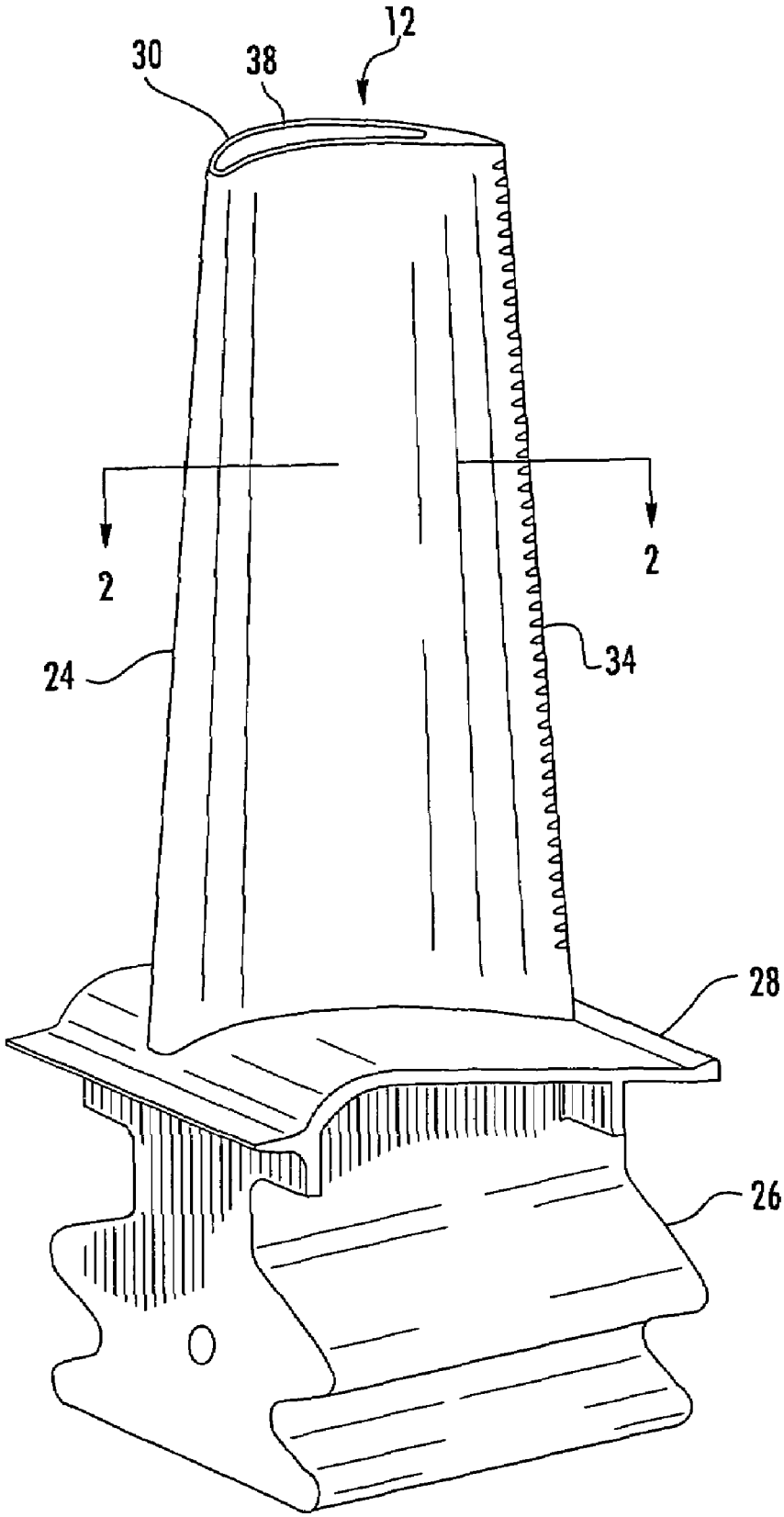
FIG. 1 is a perspective view of a turbine airfoil having features according to the instant invention.
Figure 2:
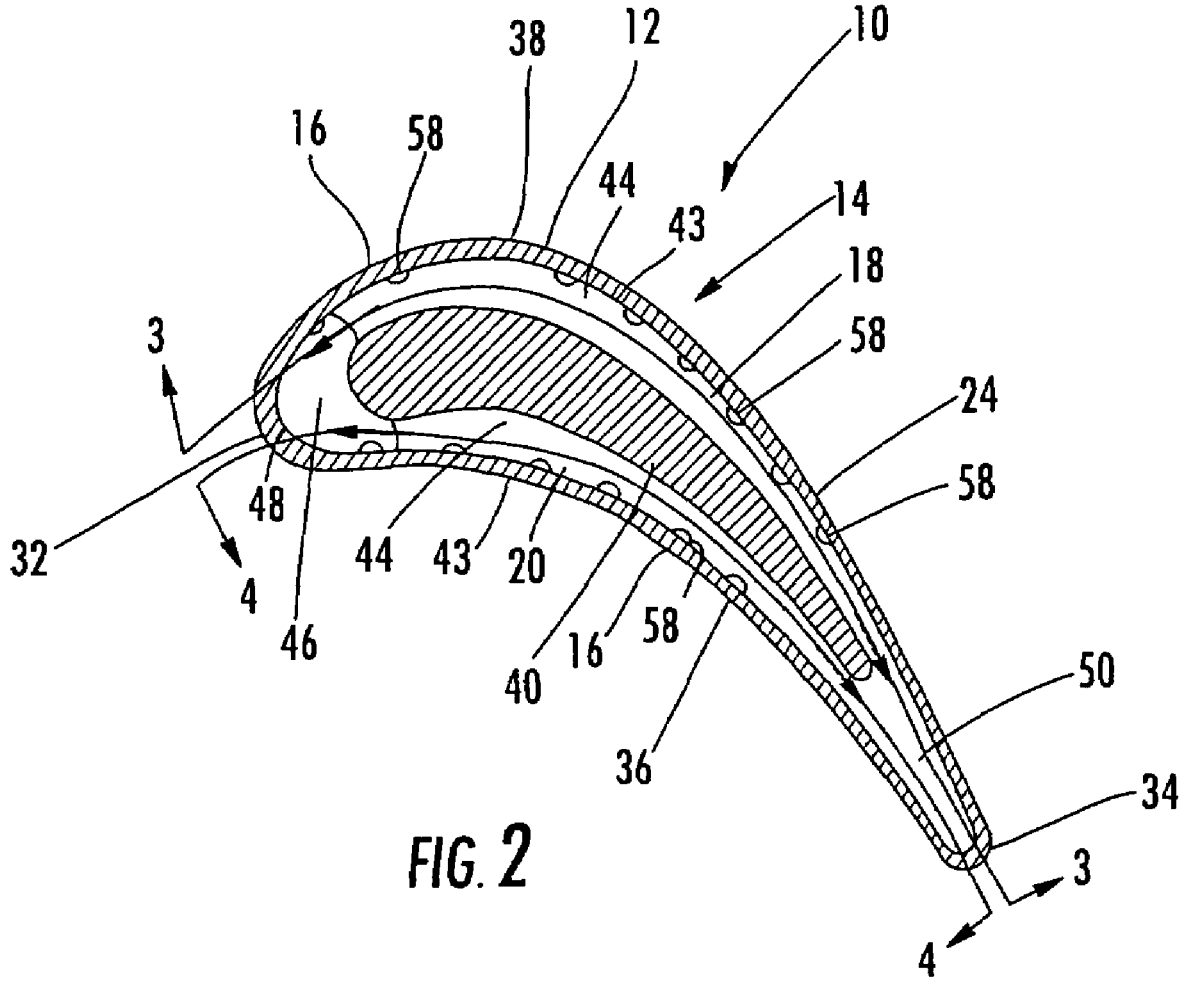
FIG. 2 is a cross-sectional view of the turbine airfoil shown in FIG. 1 taken along line 2-2.

As shown in FIGS. 1-4, this invention is directed to a turbine airfoil cooling system 10 for a turbine airfoil 12 used in turbine engines. In particular, the turbine airfoil cooling system 10 includes a plurality of internal cavities 14, as shown in FIG. 2, positioned between outer walls 16 of the turbine airfoil 12. The cooling system 10 may include a suction side serpentine cooling channel 18 and a pressure side serpentine cooling channel 20 that each extend along the length of the turbine airfoil 12 with legs 22 that extend in a generally chordwise direction. Such a configuration works well with low cooling fluid flow turbine airfoils.

The turbine airfoil 12 may be formed from a generally elongated, hollow airfoil 24 coupled to a root 26 at a platform 28. The turbine airfoil 12 may be formed from conventional metals or other acceptable materials. The generally elongated airfoil 24 may extend from the root 26 to a tip section 30 and include a leading edge 32 and trailing edge 34. Airfoil 24 may have an outer wall 16 adapted for use, for example, in a first stage of an axial flow turbine engine. Outer wall 16 may form a generally concave shaped portion forming pressure side 36 and may form a generally convex shaped portion forming suction side 38. The turbine airfoil 12 may include an internal support core 40 positioned within the internal cavity 14 between the portion of the outer wall 16 forming the suction side 38 and the portion of the outer wall 16 forming the pressure side 36. In at least one embodiment, the internal support core 40 may be formed from a metal capable of withstanding the hot environment in the turbine airfoil 12, or other appropriate material.

Figure 3:
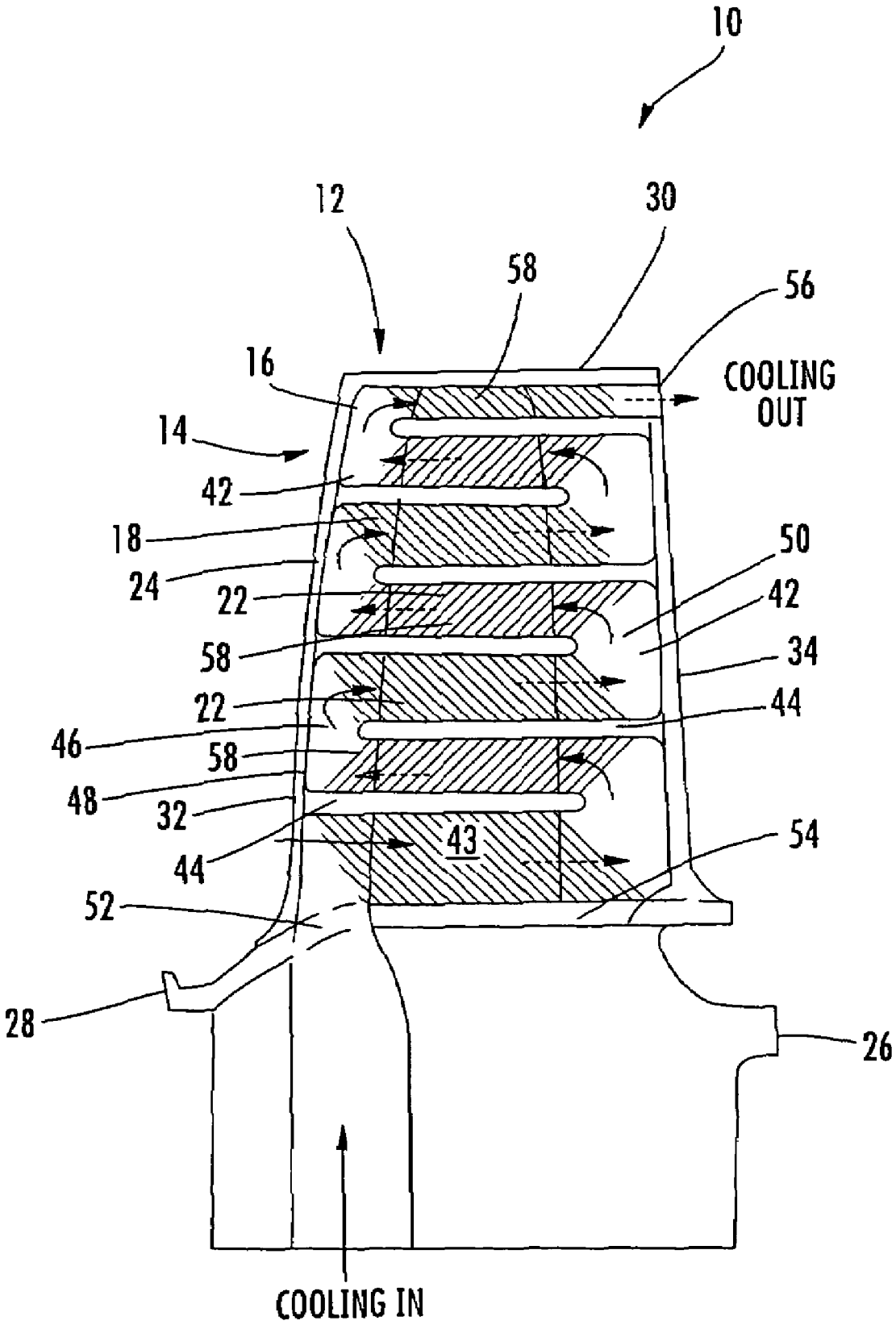
FIG. 3 is a cross-sectional view of the suction side serpentine cooling channel, also referred to as a filleted view, of the turbine airfoil shown in FIG. 1 taken along line 3-3.
Figure 4:
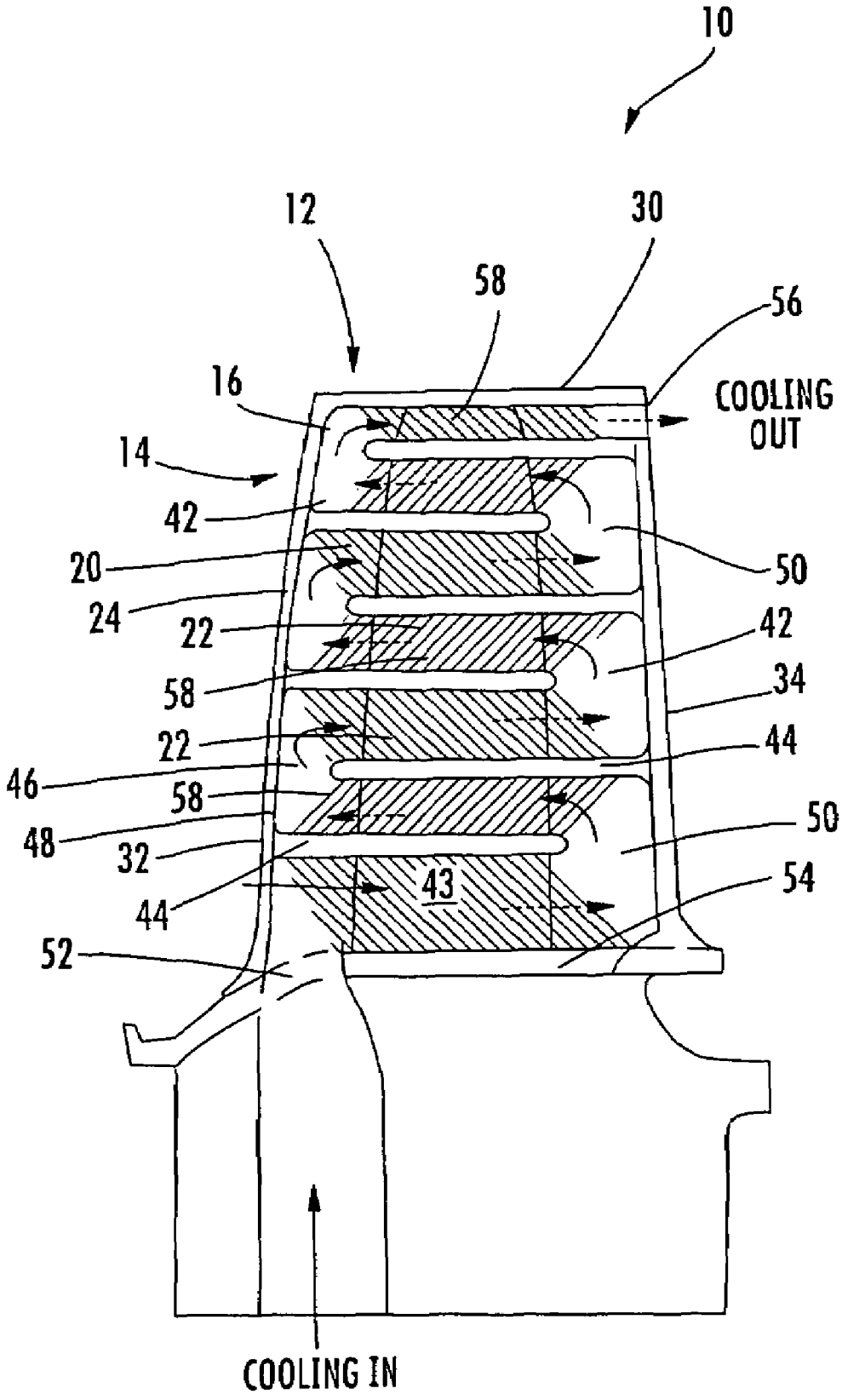
FIG. 4 is a cross-sectional view of the pressure side serpentine cooling channel, also referred to as a filleted view, of the turbine airfoil shown in FIG. 1 taken along line 4-4.

The cooling system 10, as shown in FIGS. 2-3, may include a suction side serpentine cooling channel 18 positioned proximate to the suction side 38 of the generally elongated airfoil 24 and defined by the internal support core 40 and the outer wall 16. The suction side serpentine cooling channel 18 may be formed from a plurality of legs 22 that are positioned in a generally chordwise direction and extend from the leading edge 32 to the trailing edge 34 of the generally elongated, hollow airfoil 24. In one embodiment, the suction side serpentine cooling channel 18 may be formed from three or more legs 22 coupled together with turns 42. The legs 22 may be formed with ribs 44 extending between an inner surface 43 of the outer wall 16 and the internal support core 40. In at least one embodiment, the legs 22 may extend from the root 26 to the tip section 30 or for any portion therebetween. A leg 22 forming a portion of the suction side serpentine cooling channel 18 may have width proximate to the leading edge 32 that differs from a width of the same leg 22 proximate to the trailing edge. The leg 22 may be configured such that the downstream width is smaller than the upstream width, which causes the velocity of the cooling fluids traveling therethrough to increase. The legs 22 of the suction side serpentine cooling channel 18 may be perpendicular or at a slight angle to a longitudinal axis extending from the root 26 to the tip section 30.

The cooling system 10, as shown in FIGS. 2-3, may include a pressure side serpentine cooling channel 20 positioned proximate to the pressure side 36 of the generally elongated airfoil 24 and defined by the internal support core 40 and the outer wall 16. The pressure side serpentine cooling channel 20 may be formed from a plurality of legs 22 that are positioned in a generally chordwise direction and extend from the leading edge 32 to the trailing edge 34 of the generally elongated, hollow airfoil 24. In one embodiment, the pressure side serpentine cooling channel 20 may be formed from three or more legs 22 coupled together with turns 42. The legs 22 may be formed with ribs 44 extending between an inner surface 43 of the outer wall 16 and the internal support core 40. In at least one embodiment, the legs 22 may extend from the root 26 to the tip section 30 or for any portion therebetween. A leg 22 forming a portion of the pressure side serpentine cooling channel 20 has a width proximate to the leading edge 32 that differs from a width of the same leg 22 proximate to the trailing edge 34. The leg 22 may be configured such that the downstream width is smaller than the upstream width, which causes the velocity of the cooling fluids traveling therethrough to increase. The legs 22 of the pressure side serpentine cooling channel 20 may be perpendicular or at a slight angle to a longitudinal axis extending from the root 26 to the tip section 30.

The cooling system 10 may also include a leading edge impingement channel 46 extending along the leading edge 32 of the generally elongated hollow airfoil 24. The leading edge impingement channel 46 may be configured such that cooling fluids from the suction side and pressure side serpentine cooling channels 18, 20 may impinge on the backside surface 48 of the outer wall 16 forming the leading edge 32. The leading edge impingement channel 46 may extend from the root 26 to the tip section 30 or for any portion therebetween.

The cooling system 10 may also include a trailing edge impingement channel 50 extending along the trail edge 34 of the generally elongated hollow airfoil 24. The trailing edge impingement channel 50 may be configured such that cooling fluids from the suction side and pressure side serpentine cooling channels 18, 20 may impinge on the backside surface 48 of the outer wall 16 forming the trailing edge 32. The trailing edge impingement channel 40 may extend from the root 26 to the tip section 30 or for any portion therebetween.

The cooling system 10 may include a cooling fluid inlet 52 positioned proximate to the root 26 of the airfoil blade 12 that places the suction side and pressure side serpentine cooling channels 18, 20 in fluid communication with a cooling fluid supply source. The cooling fluid inlet 52 may be positioned in an endwall 54. The cooling system 10 may also include a cooling fluid exhaust orifice 56 for exhausting cooling fluids. In at least one embodiment, the cooling fluid exhaust orifice 56 may be positioned proximate to the tip section 30 of the generally elongated hollow airfoil 24 and in fluid communication with the suction side and pressure side serpentine cooling channels 18, 20. The cooling fluid exhaust orifice 56 may extend through the trailing edge 34 of the generally elongated airfoil 24.

The cooling system 10 may also include a plurality of trip strips 58 extending into the suction side serpentine cooling channel 18 from an inner surface 43 of the outer wall 16. The cooling system 10 may also include a plurality of trip strips 58 extending into the pressure side serpentine cooling channel 20 from an inner surface 43 of the outer wall 16. The trips strips 58 may be positioned at an acute angle between a chordwise direction and a spanwise direction or in another appropriate position to enhance the cooling capacity of the cooling system 10.

The cooling system 10 may be tailored to accommodate localized exterior heat loads. In particular, the cooling system 10 may be formed such that a width of the suction side serpentine channel 18 between the internal support core 40 and the outer wall 16 differs from a width of the pressure side serpentine channel 20 between the internal support core 40 and the outer wall 16. The difference in thickness changes the cooling fluid flow distribution through the cooling system 10. The width of the suction side serpentine channel 18 may vary axially between the root 26 and the tip section 30, which impacts the cooling flow mass flux and alters the cooling capability and metal temperature along the flow path. Similarly, the width of the pressure side serpentine channel 20 may vary axially between the root 26 and the tip section 30.

During use, cooling fluids may flow into the cooling system 10 from a cooling fluid supply source through the cooling fluid inlet 52. The cooling fluids may flow into a portion of the leading edge impingement channel 46 and be split into the suction side and pressure side serpentine cooling channels 18, 20. The cooling fluids may flow through the legs 22 of the suction side and pressure side serpentine cooling channels 18, 20 and impinge onto the trailing edge 34 in the turns proximate to the trailing edge 34. The cooling fluids from the suction side and pressure side serpentine cooling channels 18, 20 mix and are passed into a leg 22 extending from the trailing edge 34 to the leading edge 32. The cooling fluids then impinge on the backside surface 48 of the leading edge 32, thereby creating a high internal heat transfer coefficient. Subsequently, as the cooling fluids turns in each leading and trailing edge turn 42, the cooling fluid changes momentum, which results in an increase of heat transfer coefficient. This pattern is repeated until the cooling fluids flow to the tip section 30 and are exhausted from the cooling system 10 through the cooling fluid exhaust orifice 56.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil;

an outer wall forming an outer surface of the generally elongated airfoil;

a suction side serpentine cooling channel positioned proximate to a suction side of the generally elongated airfoil and defined by the internal support core and the outer wall;

wherein the suction side serpentine cooling channel is formed from a plurality of legs that are positioned in a generally chordwise direction from the leading edge to the trailing edge of the generally elongated, hollow airfoil; and a pressure side serpentine cooling channel positioned proximate to a pressure side of the generally elongated airfoil and defined by the internal support core and the outer wall;

wherein the pressure side serpentine cooling channel is formed from a plurality of legs that are positioned in a generally chordwise direction from the leading edge to the trailing edge of the generally elongated, hollow airfoil;

wherein a leg forming a portion of the suction side serpentine cooling channel has a width proximate to the leading edge that differs from a width of the same leg proximate to the trailing edge.

2. The turbine airfoil of claim 1, further comprising a leading edge impingement channel extending along the leading edge of the generally elongated hollow airfoil.

3. The turbine airfoil of claim 1, further comprising a trailing edge impingement channel extending along the trailing edge of the generally elongated hollow airfoil.

4. The turbine airfoil of claim 1, further comprising a cooling fluid inlet positioned proximate to the root of the airfoil that places the suction side and pressure side serpentine cooling channels in fluid communication with a cooling fluid supply source.

5. The turbine airfoil of claim 1, further comprising a cooling fluid exhaust orifice positioned proximate to the tip section of the generally elongated hollow airfoil and in fluid communication with the suction side and pressure side serpentine cooling channels.

6. The turbine airfoil of claim 1, further comprising a plurality of trip strips extending into the suction side serpentine cooling channel from an inner surface of the outer wall.

7. The turbine airfoil of claim 6, wherein the plurality of trip strips are positioned at an acute angle between a chordwise direction and a spanwise direction.

8. The turbine airfoil of claim 1, further comprising a plurality of trip strips extending into the pressure side serpentine cooling channel from an inner surface of the outer wall.

9. The turbine airfoil of claim 8, wherein the plurality of trip strips are positioned at an acute angle between a chordwise direction and a spanwise direction.

10. The turbine airfoil of claim 1, wherein the suction side serpentine cooling channel comprises at least three legs in fluid communication with each other through turns positioned at the leading and trailing edges.

11. The turbine airfoil of claim 1, wherein the pressure side serpentine cooling channel comprises at least three legs in fluid communication with each other through turns positioned at the leading and trailing edges.

12. The turbine airfoil of claim 1, wherein a leg forming a portion of the pressure side serpentine cooling channel has a width proximate to the leading edge that differs from a width of the same leg proximate to the trailing edge.

13. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil;

an outer wall forming an outer surface of the generally elongated airfoil;

a suction side serpentine cooling channel positioned proximate to a suction side of the generally elongated airfoil and defined by the internal support core and the outer wall;

wherein the suction side serpentine cooling channel is formed from a plurality of legs that are positioned in a generally chordwise direction from the leading edge to the trailing edge of the generally elongated, hollow airfoil; and a pressure side serpentine cooling channel positioned proximate to a pressure side of the generally elongated airfoil and defined by the internal support core and the outer wall;

wherein the pressure side serpentine cooling channel is formed from a plurality of legs that are positioned in a generally chordwise direction from the leading edge to the trailing edge of the generally elongated, hollow airfoil;

wherein a width of the suction side serpentine channel between the internal support core and the outer wall differs from a width of the pressure side serpentine channel between the internal support core and the outer wall.

14. The turbine airfoil of claim 13, wherein a width of the suction side serpentine channel between the internal support core and the outer wall differs from the root to the tip section of the generally elongated hollow airfoil.

15. The turbine airfoil of claim 14, wherein a width of the pressure side serpentine channel between the internal support core and the outer wall differs from the root to the tip section of the generally elongated hollow airfoil.

16. A turbine airfoil, comprising:

a generally elongated, hollow airfoil having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil;

an outer wall forming an outer surface of the generally elongated airfoil;

an internal support core positioned in the at least one cavity;

a suction side serpentine cooling channel positioned proximate to a suction side of the generally elongated airfoil and defined by the internal support core and the outer wall;

wherein the suction side serpentine cooling channel is formed from a plurality of legs that are positioned in a generally chordwise direction from the leading edge to the trailing edge of the generally elongated, hollow airfoil;

a pressure side serpentine cooling channel positioned proximate to a pressure side of the generally elongated airfoil and defined by the internal support core and the outer wall;

wherein the pressure side serpentine cooling channel is formed from a plurality of legs that are positioned in a generally chordwise direction from the leading edge to the trailing edge of the generally elongated, hollow airfoil;

a leading edge impingement channel extending alone the leading edge of the generally elongated hollow airfoil;

a trailing edge impingement channel extending along the trailing edge of the generally elongated hollow airfoil;

a cooling fluid inlet positioned proximate to the root of the airfoil blade that places the suction side and pressure side serpentine cooling channels in fluid communication with a cooling fluid supply source;

a cooling fluid exhaust orifice positioned in the trailing edge proximate to the tip section of the generally elongated hollow airfoil and in fluid communication with the suction side and pressure side serpentine cooling channels;

wherein a leg forming a portion of the suction side serpentine cooling channel has a width proximate to the leading edge that differs from a width of the same channel proximate to the trailing edge; a leg forming a portion of the pressure side serpentine cooling channel has a width proximate to the leading edge that differs from a width of the same channel proximate to the trailing edge; a width of the suction side serpentine channel between the internal support core and the outer wall differs from the root to the tip section of the generally elongated hollow airfoil; and a width of the pressure side serpentine channel between the internal support core and the outer wall differs from the root to the tip section of the generally elongated hollow airfoil.

17. The turbine airfoil of claim 16, further comprising a plurality of trip strips extending into the suction side serpentine cooling channel from an inner surface of the outer wall and a plurality of trip strips extending into the pressure side serpentine cooling channel from an inner surface of the outer wall; wherein the plurality of trips strips in the pressure and suction side serpentine cooling channels are positioned at acute angles between a chordwise direction and a spanwise direction.

18. The turbine airfoil of claim 16, wherein a width of the suction side serpentine channel between the internal support core and the outer wall differs from a width of the pressure side serpentine channel between the internal support core and the outer wall.

* * * * *